US009760057B2

(12) United States Patent
Sawamura et al.

(10) Patent No.: US 9,760,057 B2
(45) Date of Patent: Sep. 12, 2017

(54) IMAGE FORMING APPARATUS

(71) Applicant: FUJI XEROX CO., LTD., Tokyo (JP)

(72) Inventors: Jun Sawamura, Kanagawa (JP); Hideki Sato, Kanagawa (JP); Yoshiro Konishi, Kanagawa (JP); Yasuhiro Kato, Kanagawa (JP); Takayuki Ukawa, Kanagawa (JP); Masahiro Akatsuka, Kanagawa (JP); Yusuke Sakurai, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/207,878

(22) Filed: Jul. 12, 2016

(65) Prior Publication Data

US 2017/0219993 A1 Aug. 3, 2017

(30) Foreign Application Priority Data

Feb. 2, 2016 (JP) ..... 2016-017959

(51) Int. Cl.
*G03G 21/16* (2006.01)

(52) U.S. Cl.
CPC ..... *G03G 21/1623* (2013.01); *G03G 21/1633* (2013.01); *G03G 2221/1654* (2013.01)

(58) Field of Classification Search
CPC ..... G03G 21/1623; G03G 21/1633; G03G 2221/1654; G03G 2221/169
See application file for complete search history.

(56) References Cited

U.S. PATENT DOCUMENTS

2005/0191090 A1* 9/2005 Nishimura ..... G03G 21/1821 399/113
2015/0071680 A1 3/2015 Fukuda

FOREIGN PATENT DOCUMENTS

JP 11-352859 A 12/1999
JP 2003-241615 A 8/2003
JP 2009-53563 A 3/2009
JP 2015-55786 A 3/2015

* cited by examiner

*Primary Examiner* — Erika J Villaluna
(74) *Attorney, Agent, or Firm* — Sughrue Mion, PLLC

(57) ABSTRACT

An image forming apparatus includes a cover that opens and closes an opening of an apparatus body, a unit removable from the apparatus body through the opening, a latch that is included in the unit and that is rotatable about a rotation fulcrum, the latch including a hook that is latched onto a latched portion of the apparatus body from downstream in a mounting direction of the unit to fix the unit onto the apparatus body and an operating portion that opposes the hook across the rotation fulcrum and that is operable through the opening, and a hindering portion that is included in the cover and that interferes, when the hook rotates in a separating direction in which the hook is separated from the latched portion in a state where the cover closes the opening, with the operating portion and hinders the hook from rotating in the separating direction.

4 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2016-017959 filed Feb. 2, 2016.

BACKGROUND

Technical Field

The present invention relates to an image forming apparatus.

SUMMARY

According to an aspect of the invention, there is provided an image forming apparatus including a cover member that opens and closes an opening formed in an image forming apparatus body, a unit that is removable from the image forming apparatus body through the opening, a latch member that is included in the unit in such a manner as to be capable of rotating about a rotation fulcrum portion, the latch member including a hook that is to be latched onto a to-be-latched portion of the image forming apparatus body from a downstream side in a mounting direction of the unit and that fixes the unit onto the image forming apparatus body and an operating portion that is disposed so as to oppose the hook across the rotation fulcrum portion and that is capable of being operated through the opening, and a hindering portion that is included in the cover member and that interferes, when the hook rotates in a direction in which the hook is separated from the to-be-latched portion in a state where the cover member closes the opening, with the operating portion and hinders the hook from rotating in the direction in which the hook is separated from the to-be-latched portion.

BRIEF DESCRIPTION OF THE DRAWINGS

An exemplary embodiment of the present invention will be described in detail based on the following figures, wherein.

DETAILED DESCRIPTION

Figure 1:
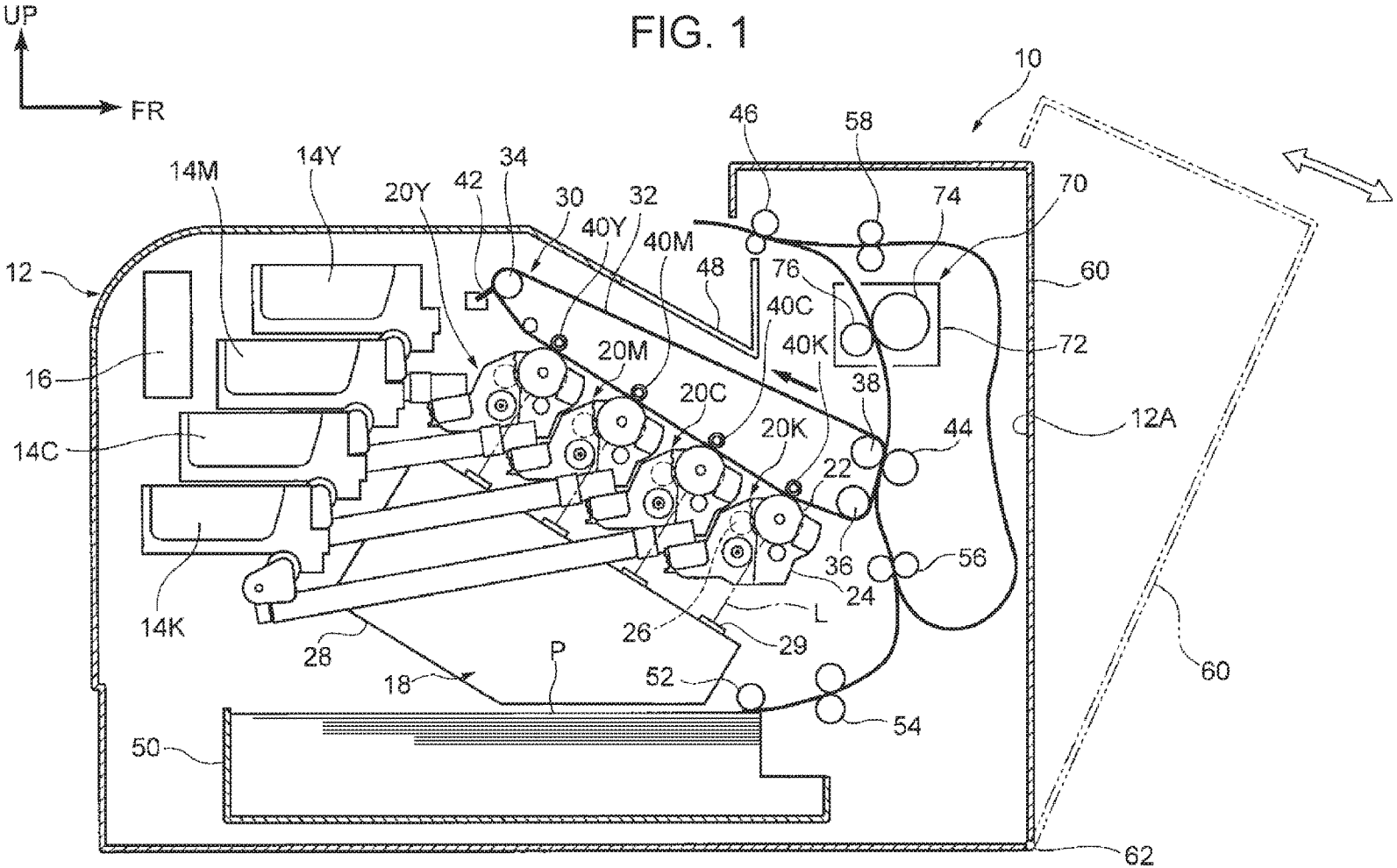
FIG. 1 is a schematic side view illustrating the overall configuration of an image forming apparatus according to an exemplary embodiment of the present invention.

An exemplary embodiment of the present invention will be described in detail below with reference to the drawings. Note that, for convenience of description, arrow UP and arrow FR that are suitably illustrated in the drawings respectively indicate an upward direction and a forward direction of an image forming apparatus 10. In addition, a direction toward the front side as viewed in FIG. 1 is a left direction of the image forming apparatus 10, and the term "when seen from the side" refers to the case of seeing from a left-right direction that is perpendicular to a mounting (inserting) direction of a fixing unit 70, which will be described later.

As illustrated in FIG. 1, an image processing unit 16 that performs image processing on image data, which is input, is disposed in the interior of an image forming apparatus body (hereinafter simply referred to as apparatus body) 12, which serves as a housing of the image forming apparatus 10. The image processing unit 16 processes image data, which has been input, into gradation data items of four colors of yellow (Y), magenta (M), cyan (C), and black (K), and an exposure device 18 that receives the processed gradation data items and performs image exposure by using laser beams L is disposed in a central area inside the apparatus body 12.

Four image forming units 20Y, 20M, 20C, and 20K, which respectively correspond to the colors Y, M, C, and K, are disposed above the exposure device 18 in such a manner as to be spaced apart from one another in a direction inclined with respect to the horizontal direction and are removable from the apparatus body 12. Note that, in the following description, when it is not necessary to describe the image forming units 20Y, 20M, 20C, and 20K in such a manner as to be distinguished in terms of color, the letters Y, M, C, and K will be omitted.

The image forming units 20 are configured in a similar manner. Each of the image forming units 20 includes an image carrier 22 that has a columnar shape and that is driven so as to rotate at a predetermined speed, a charging member 24 for first charging that charges the outer circumferential surface of the corresponding image carrier 22, a developing device 26 that develops, with a predetermined color toner, an electrostatic latent image, which has been formed on the charged outer circumferential surface of the image carrier 22 by image exposure performed by the exposure device 18, so as to visualize the electrostatic latent image as a toner image, and a cleaning blade (not illustrated) that cleans the outer circumferential surface of the image carrier 22 after the toner image has been transferred.

In addition, toner supply devices 14Y, 14M, 14C, and 14K that supply toners to the corresponding developing devices 26 are disposed in the interior of the apparatus body 12. In the exposure device 18, four semiconductor lasers (not illustrated) each having the same configuration are disposed in such a manner as to correspond to the four image forming units 20Y, 20M, 20C, and 20K, and the laser beams L are to be emitted from the semiconductor lasers in accordance with the gradation data items.

Note that each of the laser beams L, which have been emitted from the semiconductor lasers, is radiated onto a polygon mirror (not illustrated), which is a rotating polygon mirror, via a cylindrical lens (not illustrated) and is caused to be deflected and scanned by the polygon mirror. Then, each of the laser beams L, which have been caused to be deflected and scanned by the polygon mirror, is radiated onto an exposure point on the corresponding image carrier 22 via an imaging lens (not illustrated) and plural mirrors (not illustrated) and is caused to scan and irradiate the image carrier 22.

Since there is a possibility of toners and the like falling onto the exposure device 18 from the developing devices 26 and the like, which are included in the four image forming units 20Y, 20M, 20C, and 20K disposed above the exposure device 18, the periphery of the exposure device 18 is hermetically sealed by a frame 28 having a substantially rectangular parallelepiped shape. An upper portion of the frame 28 is provided with a window 29 that is made of transparent glass and that transmits the four laser beams L onto the corresponding image carriers 22.

Meanwhile, a first transfer unit 30 is disposed above the image forming units 20. The first transfer unit 30 includes an endless intermediate transfer belt 32, a driving roller 34 around which the intermediate transfer belt 32 is wound and which drives the intermediate transfer belt 32 so that the intermediate transfer belt 32 moves circularly in the direction of an arrow in FIG. 1, a tension-applying roller 36 around which the intermediate transfer belt 32 is wound and which exerts tension on the intermediate transfer belt 32, a driven roller 38 that is disposed above the tension-applying roller 36 and that is driven so as to rotate by the intermediate transfer belt 32, and first transfer rollers 40Y, 40M, 40C, and 40K each of which is positioned on the side opposite to the side on which a corresponding one of the image carriers 22 is disposed with the intermediate transfer belt 32 interposed therebetween.

Toner images of the colors Y, M, C, and K, which have been sequentially formed on the image carriers 22 of the corresponding image forming units 20Y, 20M, 20C, and 20K, are transferred onto the intermediate transfer belt 32 in such a manner that the toner images are superposed with one another by the four transfer rollers 40Y, 40M, 40C, and 40K. Note that a cleaning blade 42 that cleans an outer peripheral surface of the intermediate transfer belt 32 is disposed so as to be positioned on the side opposite to the side on which the driving roller 34 is disposed with the intermediate transfer belt 32 interposed therebetween.

A second transfer roller 44 is disposed so as to be positioned on the side opposite to the side on which the driven roller 38 is disposed with the intermediate transfer belt 32 interposed therebetween, and a portion where the intermediate transfer belt 32 and the second transfer roller 44 are in contact with each other serves as a second transfer position. Accordingly, the toner images of the colors Y, M, C, and K, which have been transferred to the intermediate transfer belt 32 in such a manner that the toner images are superposed with one another, are transported by the intermediate transfer belt 32 and are transferred in a second transfer process onto one of sheet members P, each of which is an example of a recording medium.

The fixing unit 70 that fixes toner images that have been transferred to one of the sheet members P onto the sheet member P is disposed at a position downstream from the second transfer position in a transport direction of the sheet members P. Note that the term "in the transport direction of the sheet members P" will hereinafter be omitted when describing such a position downstream from something. The fixing unit 70 is an example of a unit that is removable from the apparatus body 12, and details of mounting and unmounting mechanisms 80 (see FIG. 2) of the fixing unit 70 that are used for mounting and unmounting the fixing unit 70 on and from the apparatus body 12 will be described later.

The fixing unit 70 includes a heating roller 74 and a pressure roller 76, and toner images are fixed onto one of the sheet members P as a result of the sheet member P passing through a portion where the pressure roller 76 and the heating roller 74 are in contact with each other (as a result of applying heat and pressure to the sheet member P). Ejection rollers 46 that eject the sheet member P, to which the toner images have been fixed, to an ejecting section 48 that is formed in an upper portion of the apparatus body 12 are each disposed at a position downstream from the fixing unit 70.

Meanwhile, a sheet-feeding member 50 in which the sheet members P are accommodated is disposed in a lower area of the apparatus body 12. A sheet-feeding roller 52 that sends out the sheet members P, which are accommodated in the sheet-feeding member 50, to a sheet-transport path is disposed at a position downstream from the sheet-feeding member 50, and a pair of separation rollers 54 that transport the sheet members P by separating the sheet members P one by one and are each disposed at a position downstream from the sheet-feeding roller 52.

A pair of registration rollers 56 that adjust a transfer timing are each disposed at a position downstream from the separation rollers 54. Consequently, as a result of rotation of the registration rollers 56, one of the sheet members P that has supplied from the sheet-feeding member 50 is sent out, at a predetermined transfer timing, to the second transfer position where the intermediate transfer belt 32 and the second transfer roller 44 are in contact with each other.

Transport rollers 58 that transport one of the sheet members P to the registration rollers 56 again in the case of printing an image on the two surfaces of the sheet member P are disposed in front of the ejection rollers 46. The sheet member P is flipped over as a result of being transported along a transport path for two-sided printing by the transport rollers 58 and is transported to the registration rollers 56 again.

An image forming process to be executed by the image forming apparatus 10 will now be briefly described.

First, gradation data items of different colors are sequentially output from the image processing unit 16 to the exposure device 18, and each of the laser beams L, which are emitted from the exposure device 18 in accordance with the gradation data items of the different colors, is caused to scan and irradiate the outer circumferential surface of the corresponding image carrier 22, which has been charged by the corresponding charging member 24. As a result, electrostatic latent images are formed on the outer circumferential surfaces of the image carriers 22.

The electrostatic latent images that have been formed on the image carriers 22 are visualized as toner images of the colors Y, M, C, and K, respectively, by the corresponding developing devices 26. Then, by the transfer rollers 40Y, 40M, 40C, and 40K of the first transfer unit 30, which is arranged above the image forming units 20Y, 20M, 20C, and 20K, the toner images of the colors Y, M, C, and K that have been formed on the corresponding image carriers 22 are transferred onto the intermediate transfer belt 32, which moves circularly, in such a manner that the toner images are superposed with one another.

Meanwhile, one of the sheet members P is transported to the sheet-transport path from the sheet-feeding member 50 by the sheet-feeding roller 52 and the separation rollers 54 and is transported to the second transfer position at a predetermined transfer timing by the registration rollers 56. The toner images of the different colors that have been transferred to the intermediate transfer belt 32, which moves circularly, in such a manner that the toner images are superposed with one another are transferred in a second transfer process onto the sheet member P at the second transfer position.

The sheet member P to which the toner images have been transferred is transported to the fixing unit 70, and the toner images, which have been transferred to the sheet member P, are fixed onto the sheet member P by the heating roller 74 and the pressure roller 76. The sheet member P to which the toner images have been fixed is ejected to the ejecting section 48, which is formed in an upper portion of the apparatus body 12, by the ejection rollers 46.

Note that, in the case of printing an image on the two surfaces of one of the sheet members P, the sheet member P having toner images fixed to one surface thereof by the fixing unit 70 will not be ejected to the ejecting section 48 by the ejection rollers 46 and is transported to the transport path for two-sided printing by the transport rollers 58 as a result of the transport direction of the sheet member P being switched.

The sheet member P that has been flipped over as a result of being transported along the transport path for two-sided printing is transported to the registration rollers 56 again, and toner images are transferred and fixed onto the other surface of the sheet member P. The sheet member P having the toner images fixed to the two surfaces thereof in the above manner is ejected to the ejecting section 48 by the ejection rollers 46.

The mounting and unmounting mechanisms 80 of the fixing unit 70 that are used for mounting and unmounting the fixing unit 70 on and from the apparatus body 12 will now be described in detail.

As illustrated in FIG. 1, an opening 12A is formed in the apparatus body 12 on the front side, and a cover member 60, which is included in the apparatus body 12, opens and closes the opening 12A. A lower end portion (a portion positioned below protruding portions 64, which will be described later) of the cover member 60 is rotatably supported by a support shaft 62, which is an example of a rotary support portion having an axial direction parallel to the left-right direction, and accordingly, the cover member 60 is to be opened and closed in the direction of the other arrow in FIG. 1.

Figure 3:
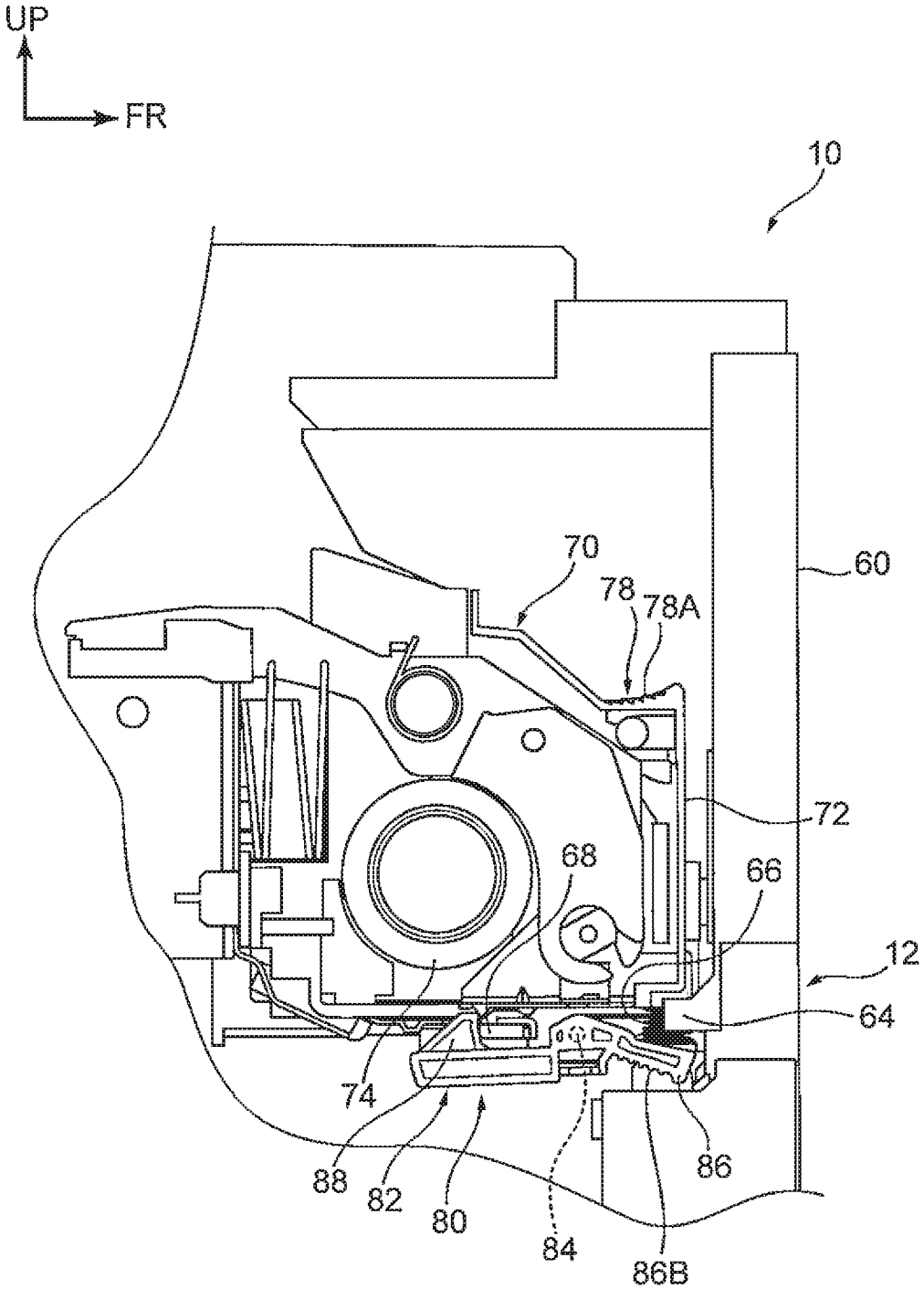
FIG. 3 is a schematic side view of the fixing unit that is mounted in and fixed to the image forming apparatus according to the exemplary embodiment.

As illustrated in FIG. 3, a pair of the protruding portions 64, each of which is an example of a hindering portion, are integrally formed on the left and right sides of an intermediate portion of the inner surface of the cover member 60 in a height direction in such a manner as to protrude from the intermediate portion. When the cover member 60 closes the opening 12A, each of the protruding portions 64 is inserted into a space between a lower surface 72A of a housing 72 (described later) of the fixing unit 70 and an upper surface 86A of a corresponding one of operating portions 86. End surfaces of the protruding portions 64, the end surfaces facing toward the rear side in a state where the cover member 60 closes the opening 12A are flat or substantially flat surfaces 64A (see FIG. 4).

Figure 2:
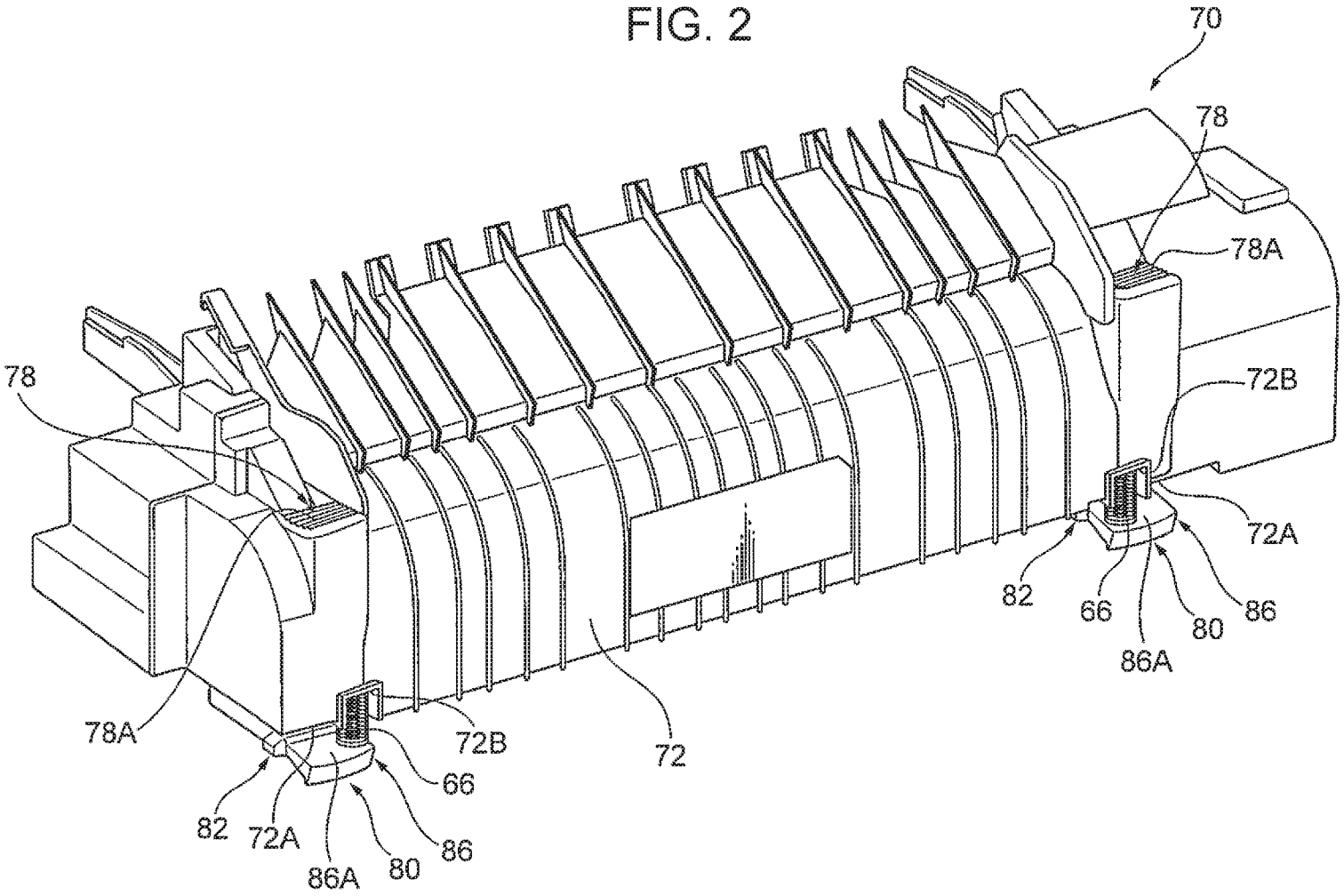
FIG. 2 is a schematic perspective view of a fixing unit of the image forming apparatus according to the exemplary embodiment.

As illustrated in FIG. 2 and FIG. 3, the fixing unit 70 includes the housing 72 having a long length in the left-right direction, and the heating roller 74 and the pressure roller 76 (see FIG. 1) are disposed in the housing 72. The fixing unit 70 is removable from the apparatus body 12 by hand through the opening 12A, which is formed as a result of the cover member 60 being opened, in a front-rear direction.

A pair of left and right holding portions 78 that are to be pressed from above by thumbs of both hands are formed at the opposite upper ends of the housing 72 in the longitudinal direction of the housing 72, the opposite upper ends being located on the side on which a surface of the housing 72 is present, the surface facing the front side and being exposed through the opening 12A. Plural grooves 78A each extending in the left-right direction are formed in upper surfaces of the holding portions 78 in order to prevent fingers from slipping. A pair of left and right latch members 82 that are to be pressed by index fingers of both hands are formed at the opposite lower ends of the housing 72 in the longitudinal direction, the opposite lower ends being located on the side on which the surface of the housing 72 is present, the surface facing the front side and being exposed through the opening 12A.

Figure 4:
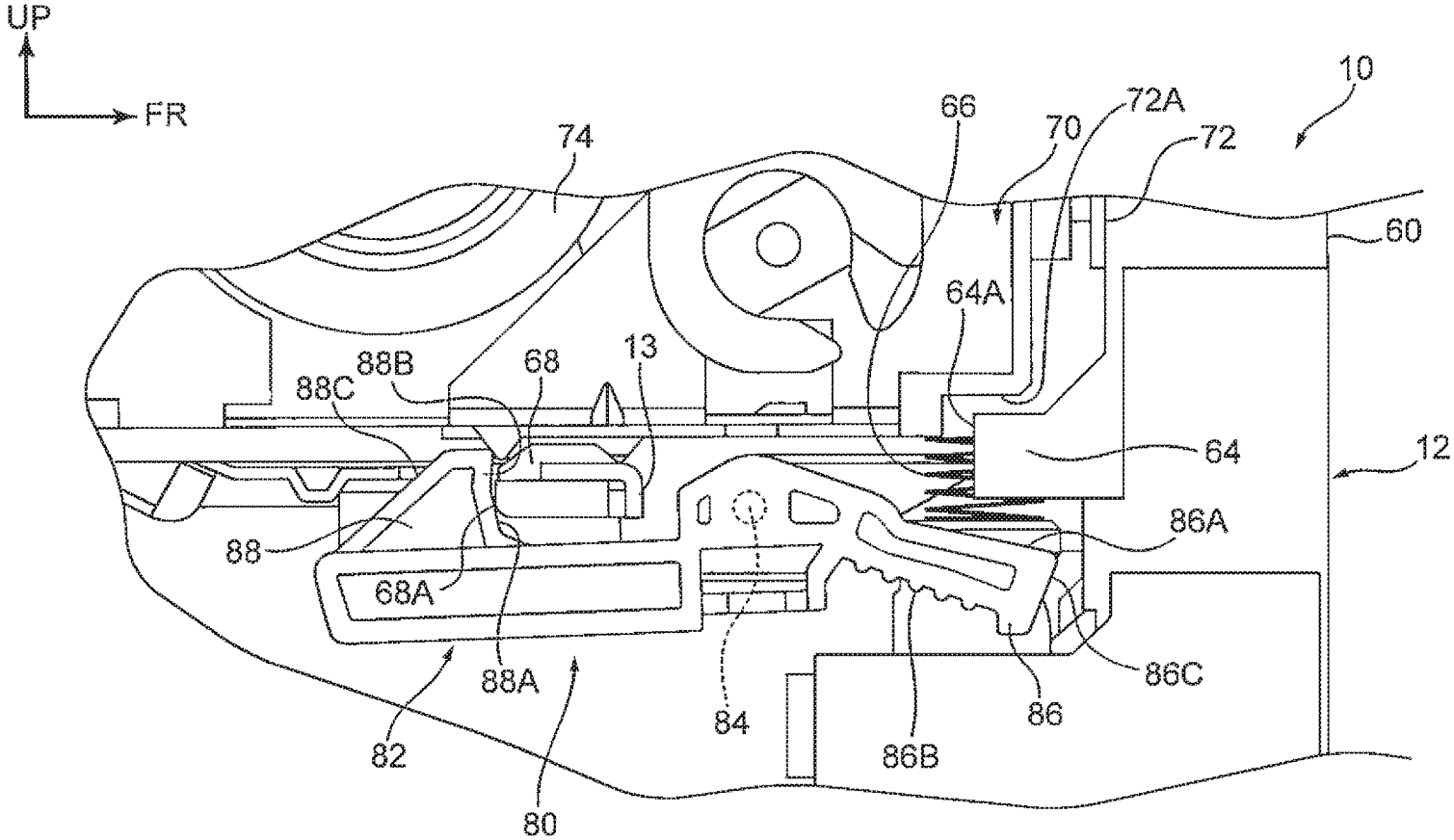
FIG. 4 is a schematic enlarged side view of a mounting and unmounting mechanism included in the fixing unit of the image forming apparatus according to the exemplary embodiment.

As illustrated in FIG. 2 and FIG. 4, the longitudinal direction of the latch members 82, which are included in the mounting and unmounting mechanisms 80 of the fixing unit 70, is parallel to the front-rear direction, and a substantially central portion of each of the latch members 82 in the front-rear direction is a rotation fulcrum portion 84 having an axial direction parallel to the left-right direction. In other words, front side end portions (operating portions 86, which will be described later) and rear side end portions (hooks 88, which will be described later) of the latch members 82 rotate in a top-bottom direction about the corresponding rotation fulcrum portions 84.

The front side end portions (upstream side end portions in a mounting direction of the fixing unit 70) of the latch members 82 each have a reasonable width in the left-right direction and are the operating portions 86 that are to be pressed by index fingers from below (that are capable of being operated through the opening 12A). Plural grooves 86B each extending in the left-right direction are formed in lower surfaces of the operating portions 86 in order to prevent fingers from slipping. A surface of each of the operating portions 86, the surface facing the front side, is an end surface 86C.

The operating portions 86 are urged downward by compression-coil springs 66, each of which is an example of an urging member. In other words, upper ends of the compression-coil springs 66 are attached to the lower surface 72A of the housing 72, and lower ends of the compression-coil springs 66 are attached to the upper surfaces 86A of the corresponding operating portions 86 in such a manner as to be located inside the upper surfaces 86A in the left-right direction.

Consequently, the operating portions 86 are constantly urged downward, and when the fixing unit 70 is mounted in (inserted into) the apparatus body 12, each of the operating portions 86 is pressed upward against an urging force of the corresponding compression-coil spring 66 (is caused to rotate upward about the corresponding rotation fulcrum portions 84).

Note that, as illustrated in FIG. 2, recesses 72B, each of which is recessed upward, may be formed in the lower surface 72A of the housing 72, and upper portions of the compression-coil springs 66 may be accommodated in the recesses 72B while the upper ends of the compression-coil springs 66 are attached to top surfaces of the recesses 72B.

Figure 5:
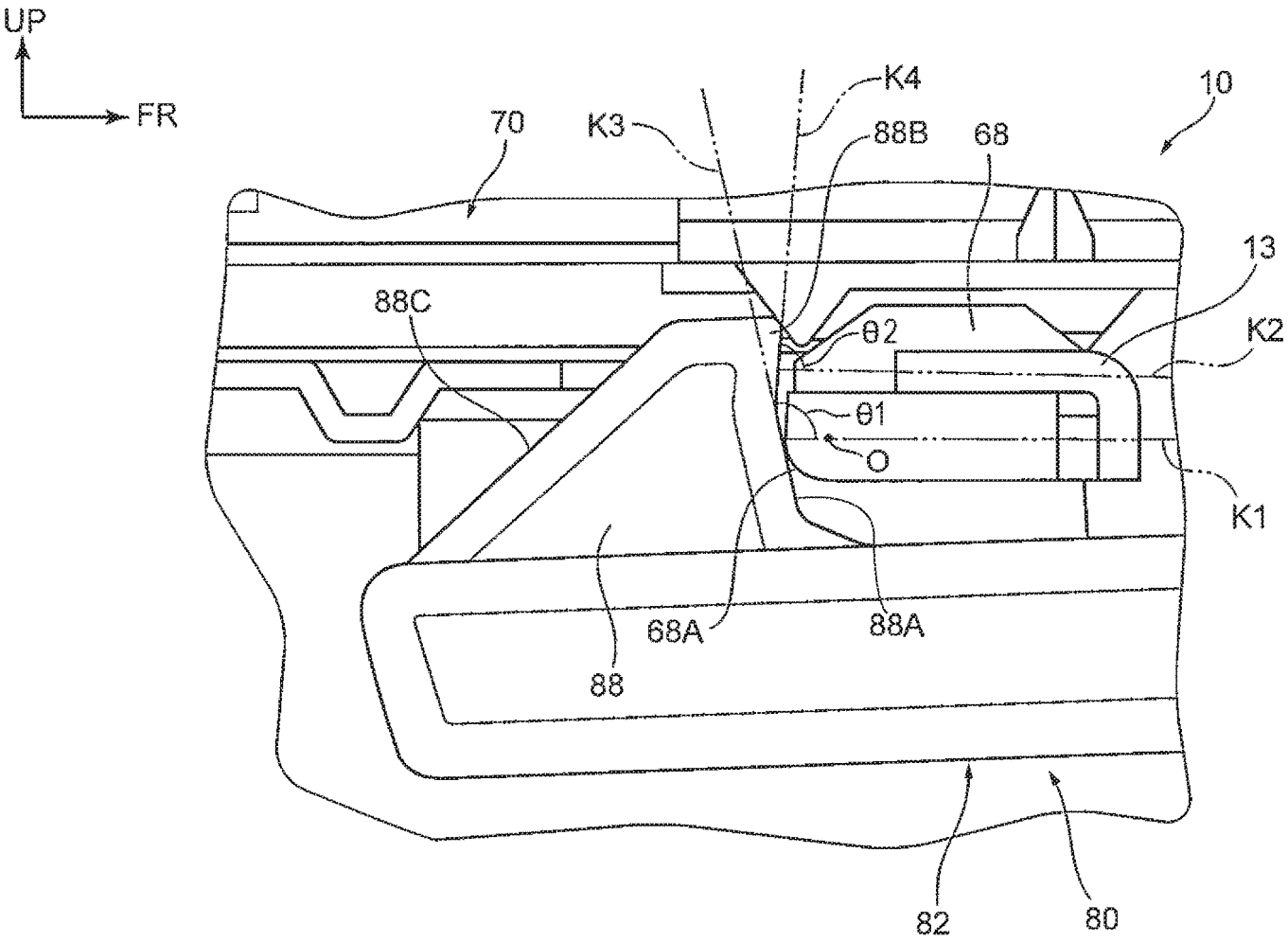
FIG. 5 is a schematic enlarged side view of a portion of a latch member included in the mounting and unmounting mechanism of the fixing unit of the image forming apparatus according to the exemplary embodiment, the portion being on the side on which a hook is present.

On the other hand, the rear side end portions (downstream side end portions in the mounting direction of the fixing unit 70) of the latch members 82 are the hooks 88 that are latched onto to-be-latched portions 68, which are included in the apparatus body 12. As illustrated in FIG. 5, the to-be-latched portions 68 are fixed, in a so-called snap-fit manner, to support portions 13 that are included in the apparatus body 12 and each of which is substantially L-shaped when seen from the side by being inserted into the support portions 13 from the rear side. A rear end lower surface of each of the to-be-latched portions 68 is an arc-shaped or substantially arc-shaped surface 68A that is an example of a contact surface formed so as to have an arc shape or a substantially arc shape when seen from the side.

The hooks 88 protrude upward, and front lower portions of the hooks 88 are linear or substantially linear contact portions 88A that are brought into contact with the arc-shaped or substantially arc-shaped surfaces 68A of the corresponding to-be-latched portions 68 at a predetermined pressure (by the urging force of the corresponding compression-coil springs 66) from the rear side (the downstream side in the mounting direction of the fixing unit 70). With this configuration, the contact portions 88A of the hooks 88 are secured to the arc-shaped or substantially arc-shaped surfaces 68A of the corresponding to-be-latched portions 68, and as a result, the fixing unit 70 is fixed to the apparatus body 12.

As illustrated in FIG. 5, in a state where the contact portion 88A of each of the contact portions 88A is secured to the arc-shaped or substantially arc-shaped surface 68A of the corresponding to-be-latched portion 68, an angle θ1 formed by a contact-portion imaginary line K1 extending from the center of rotation of the corresponding rotation fulcrum portion 84 to the contact portion 88A through a center O of a circle formed of the arc-shaped or substantially arc-shaped surface 68A of the to-be-latched portion 68 and an imaginary line K3 indicating an extending direction of the contact portion 88A is set to be 90 degrees or about 90 degrees or larger.

Front upper portions of the hooks 88 (tip portions of the hooks 88 located above the corresponding contact portions 88A) are barb portions 88B each of which overlaps a rear end upper surface of the corresponding to-be-latched portion 68 from the rear side (in such a manner as to pass through the imaginary line K3 in a securing direction). An angle θ2 formed by a barb-portion imaginary line K2 extending from the center of rotation of one of the rotation fulcrum portions 84 to the corresponding barb portion 88B and an imaginary line K4 indicating an extending direction of the barb portion 88B is set to be 90 degrees or about 90 degrees or smaller. Note that each of the barb portions 88B is formed in such a manner that the angle θ2 is 90 degrees or about 90 degrees or smaller whichever portion of the barb portion 88B the barb-portion imaginary line K2 passes through.

Rear portions of the hooks 88 are inclined portions 88C each of which is inclined forward and upward (rearward and downward) when seen from the side as illustrated in FIG. 5. When, for example, the fixing unit 70 is mounted in the apparatus body 12 in a state where the operating portions 86 are not pressed upward, the inclined portions 88C function as guide portions, which cause the corresponding hooks 88 to rotate downward about the corresponding rotation fulcrum portions 84, by being brought into slidable contact with lower surfaces of the corresponding support portions 13.

Operation of the mounting and unmounting mechanisms 80 of the fixing unit 70, which have the above-described configuration, will now be described.

The cover member 60 opens the opening 12A of the apparatus body 12 of the image forming apparatus 10 by rotating forward about the support shaft 62. When mounting the fixing unit 70 in the apparatus body 12, first, the holding portions 78, which are formed in the upper portion of the housing 72, and the operating portions 86 of the latch members 82, which are formed in the lower portion of the housing 72, are clamped by thumbs and index fingers.

As a result, the operating portions 86 are pressed upward against the urging force of the corresponding compression-coil springs 66 and move (rotate) upward about the corresponding rotation fulcrum portions 84. In other words, the hooks 88 move (rotate) downward about the corresponding rotation fulcrum portions 84. In this state, the fixing unit 70 is inserted into (mounted in) the apparatus body 12 through the opening 12A.

The hooks 88 are moved downward as a result of moving the operating portions 86 upward about the rotation fulcrum portions 84. Consequently, the hooks 88 are prevented from interfering with the corresponding support portions 13 through a process in which the fixing unit 70 is mounted in the apparatus body 12. Note that, since each of the hooks 88 includes the inclined portion 88C, even if the amount of downward movement of the hook 88 is not sufficient, the hook 88 moves downward while being guided by the lower surface of the corresponding support portion 13.

After the fixing unit 70 has been mounted in the apparatus body 12, thumbs and index fingers are released from the holding portions 78 and the operating portions 86. Then, the operating portions 86 are caused to move downward about the corresponding rotation fulcrum portions 84 by the urging force of the corresponding compression-coil springs 66, and the contact portions 88A of the hooks 88 are brought into contact with the arc-shaped or substantially arc-shaped surfaces 68A of the corresponding to-be-latched portions 68 at a predetermined pressure (by the urging force of the compression-coil springs 66) from the rear side. As a result, the fixing unit 70 is fixed to the apparatus body 12.

Note that, in this case, the angle θ1 formed by the contact-portion imaginary line K1 extending from one of the rotation fulcrum portions 84 to the corresponding contact portion 88A through the center O of the circle formed of the arc-shaped or substantially arc-shaped surface 68A of the corresponding to-be-latched portion 68 and the imaginary line K3 indicating the extending direction of the contact portion 88A is set to be 90 degrees or about 90 degrees or larger (see FIG. 5).

After the fixing unit 70 has been fixed to the apparatus body 12 in the above manner, the cover member 60 is caused to rotate about the support shaft 62 in a direction opposite to the above-mentioned direction so as to close the opening 12A.

When the cover member 60 closes the opening 12A, each of the protruding portions 64, which are formed on the inner surface of the cover member 60 in such a manner as to protrude from the inner surface, is inserted between the lower surface 72A of the housing 72 and an area outside the upper surface 86A of the corresponding operating portion 86 in the left-right direction (see FIG. 4). Here, in the case where an external force is applied to the fixing unit 70 in a direction in which the fixing unit 70 is separated from the apparatus body 12 (such as when, for example, the image forming apparatus 10 is dropped), the hooks 88 rotate in a direction in which the hooks 88 are separated from the corresponding to-be-latched portions 68 (see FIG. 6).

Figure 6:
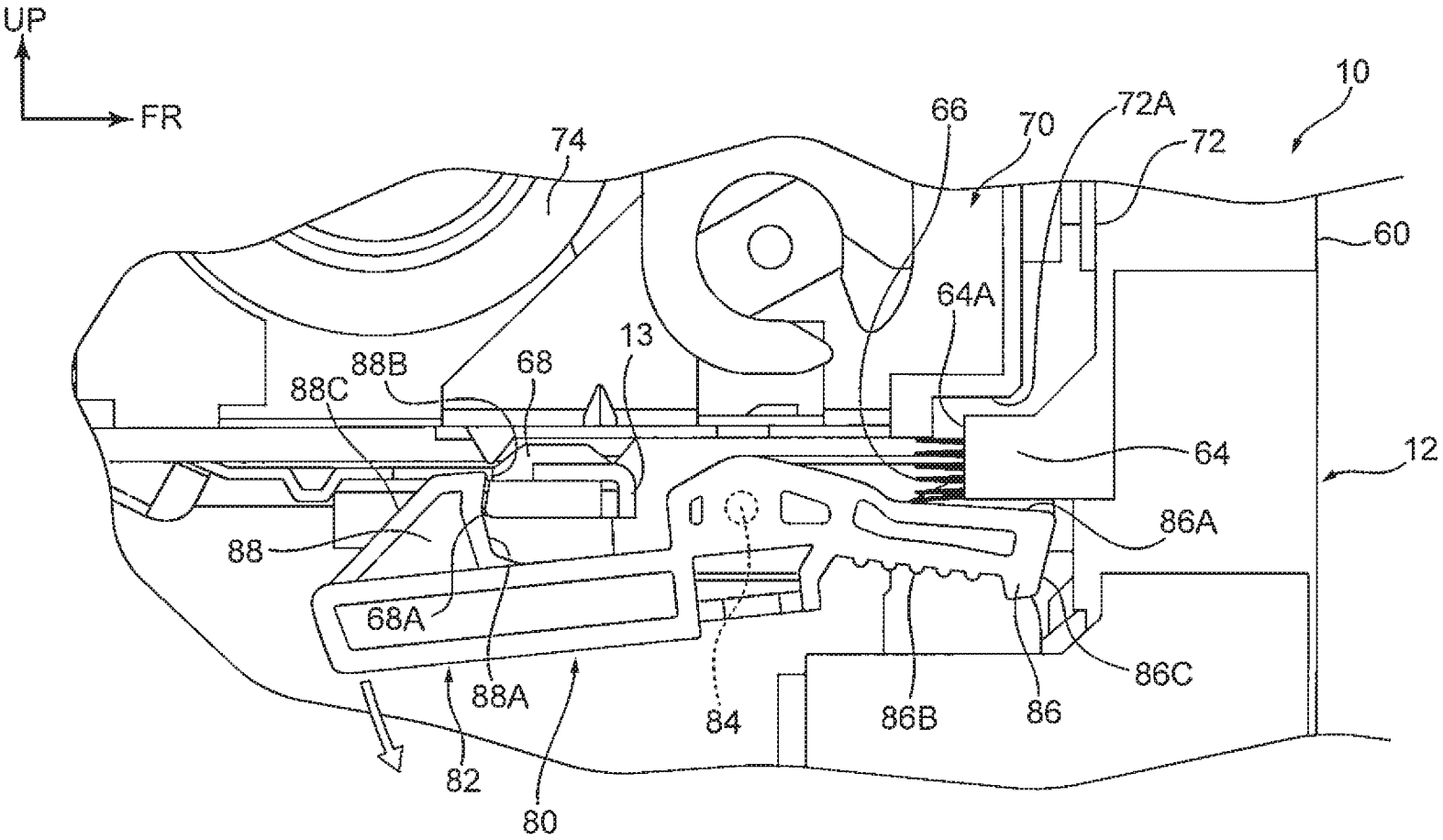
FIG. 6 is a schematic side view illustrating a state where the hook of the latch member is not separated from a to-be-latched portion even though an external force has acted on the image forming apparatus according to the exemplary embodiment.

However, as illustrated in FIG. 6, since each of the protruding portions 64 is inserted between the lower surface 72A of the housing 72 and the area outside the upper surface 86A of the corresponding operating portion 86 in the left-right direction, when the hooks 88 rotate in the direction in which the hooks 88 are separated from the corresponding to-be-latched portions 68 in a state where the cover member 60 closes the opening 12A, the operating portions 86 interfere with the corresponding protruding portions 64, and the hooks 88 are hindered, by the protruding portions 64, from rotating in the direction in which the hooks 88 are separated from the corresponding to-be-latched portions 68.

In other words, according to the mounting and unmounting mechanisms 80 of the fixing unit 70 of the present exemplary embodiment, the probability of the fixing unit 70, which is removable from the apparatus body 12, becoming separated from the apparatus body 12 due to an external force, such as vibration or a drop impact, is reduced, or the fixing unit 70 is prevented from becoming separated from the apparatus body 12 apparatus body 12 due to an external force, such as vibration or a drop impact, compared with the configuration in which the cover member 60 is not provided with the protruding portions 64 that hinder the corresponding hooks 88 from rotating in the direction in which the hooks 88 are separated from the corresponding to-be-latched portions 68.

In addition, since the angle θ2 formed by the barb-portion imaginary line K2 extending from one of the rotation fulcrum portions 84 to the corresponding barb portion 88B and the imaginary line K4 indicating the extending direction of the barb portion 88B is set to be 90 degrees or about 90 degrees or smaller, each of the barb portions 88B of the hooks 88 is less likely to be separated from the corresponding to-be-latched portion 68 compared with the configuration in which the angle θ2 is larger than 90 degrees or about 90 degrees.

Figure 7:
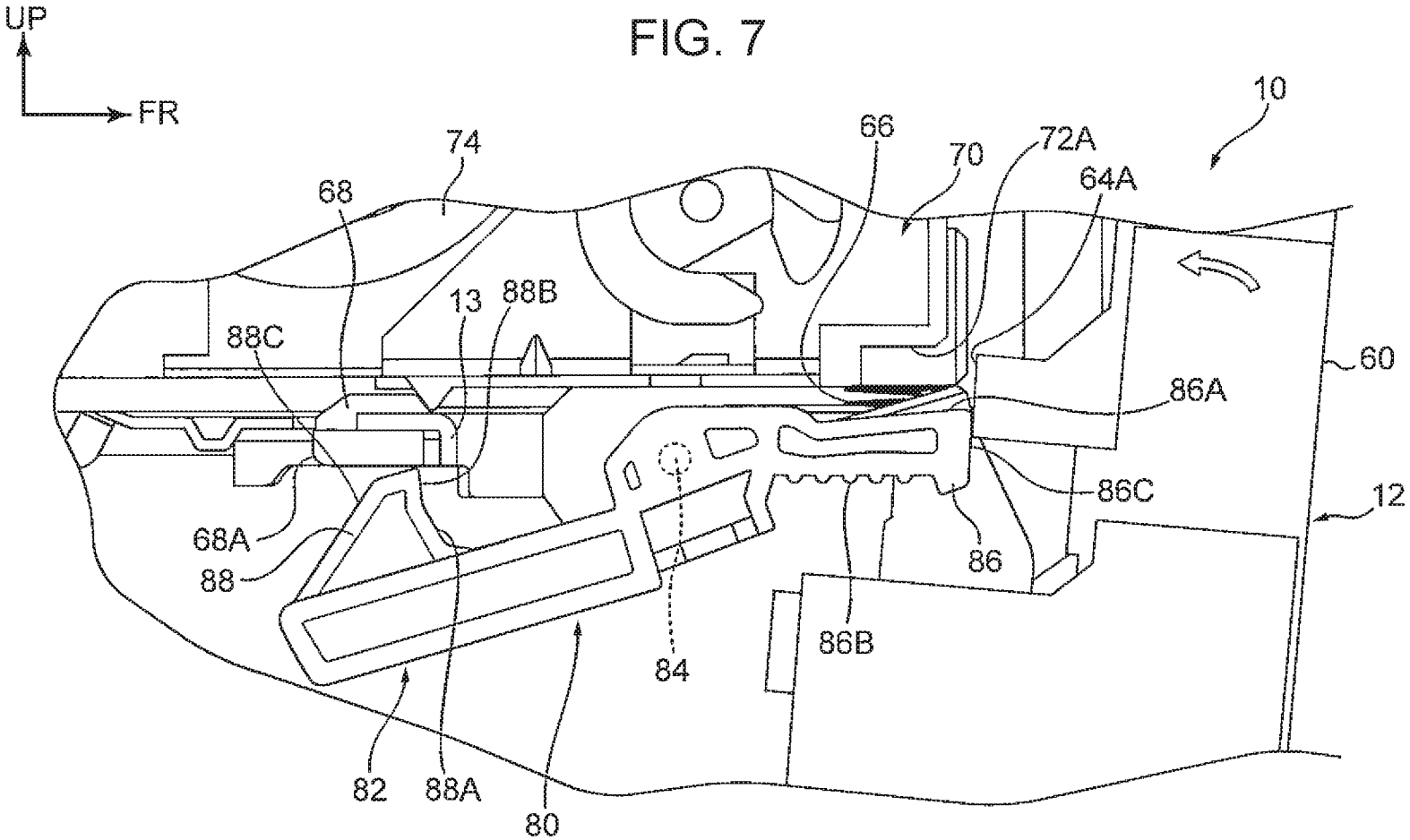
FIG. 7 is a schematic side view illustrating a state where a cover member is not closed when the fixing unit of the image forming apparatus according to the exemplary embodiment is not completely mounted in the image forming apparatus body.

As illustrated in FIG. 7, when performing an operation for closing the cover member 60 in a state where the hooks 88 are not latched to the corresponding to-be-latched portions 68, the flat or substantially flat surfaces 64A of the protruding portions 64 come into surface contact with the end surfaces 86C of the corresponding operating portions 86, and accordingly, it is difficult to close the cover member 60. Therefore, the likelihood of failure of mounting the fixing unit 70 in the apparatus body 12 is reduced, or failure of mounting the fixing unit 70 in the apparatus body 12 is prevented from occurring compared with the configuration in which the protruding portions 64 do not have the flat or substantially flat surfaces 64A, which hinder the cover member 60 from closing the opening 12A.

In other words, a probability of occurrence of a problem in that the cover member 60 is closed in a state where the fixing unit 70 is not mounted in the apparatus body 12 is reduced, or a problem in that the cover member 60 is closed in a state where the fixing unit 70 is not mounted in the apparatus body 12 is prevented from occurring. Note that, in this case, the fixing unit 70 is pushed into the apparatus body 12 by forcibly closing the cover member 60, and the hooks 88 are latched onto the corresponding to-be-latched portions 68. Therefore, the likelihood of the failure of mounting the fixing unit 70 in the apparatus body 12 is further reduced, or the failure of mounting the fixing unit 70 in the apparatus body 12 is further prevented from occurring.

Although the image forming apparatus 10 according to the present exemplary embodiment has been described above with reference to the drawings, the image forming apparatus 10 according to the present exemplary embodiment is not limited to that illustrated in the drawings, and design changes may be suitably made within the gist of the present invention. For example, the mounting and unmounting mechanisms 80 according to the present exemplary embodiment are not limited to being included in the fixing unit 70 and may be included in a different unit, such as the first transfer unit 30, that is removable from the apparatus body 12.

In addition, the to-be-latched portions 68 are not limited to having the shape illustrated in the drawings as long as the rear end lower surfaces of the to-be-latched portions 68, with which the contact portions 88A of the corresponding hooks 88 are brought into contact, are the arc-shaped or substantially arc-shaped surfaces 68A each of which is formed so as to have an arc shape or a substantially arc shape when seen from the side. Therefore, each of the to-be-latched portions 68 may be, for example, a columnar shaft (not illustrated).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a cover member configured to open and close an opening formed in an image forming apparatus body;

a unit that is removable from the image forming apparatus body through the opening;

a latch member that is included in the unit in such a manner as to be capable of rotating about a rotation fulcrum portion, the latch member including:

a hook that is configured to be latched onto a to-be-latched portion of the image forming apparatus body from a downstream side in a mounting direction of the unit and that is configured to fix the unit onto the image forming apparatus body; and an operating portion that is disposed so as to oppose the hook across the rotation fulcrum portion and that is capable of being operated through the opening; and a hindering portion that is included in the cover member and that is configured to interfere, when the hook rotates in a direction in which the hook is separated from the to-be-latched portion in a state where the cover member closes the opening, with the operating portion and to hinder the hook from rotating in the direction in which the hook is separated from the to-be-latched portion, wherein the hook includes a contact portion that is formed so as to have a substantially linear sham when seen from the side in a direction perpendicular to the mounting direction of the unit and that is configured to be brought into contact with a contact surface of the to-be-latched portion, wherein the contact surface of the to-be-latched portion is a substantially arc-shaped surface when seen from the side in the direction perpendicular to the mounting direction of the unit, and wherein an angle formed by a contact-portion imaginary line extending from the rotation shaped surface and an imaginary line indicating an extending direction of the contact portion is set to be about 90 degrees or larger.

2. The image forming apparatus according to claim 1, wherein the cover member is configured to open and close the opening by rotating about a rotary support portion positioned below the hindering portion.

3. The image forming apparatus according to claim 2, wherein the hindering portion has a substantially flat surface that is configured to come into surface contact with an end surface of the operating portion and to hinder the cover member from closing the opening when performing an operation for closing the cover member in a state where the hook is not latched to the to-be-latched portion.

4. The image forming apparatus according to claim 1, wherein a portion of the hook that is closer than the contact portion to a tip end of the hook is a barb portion that overlaps the to-be-latched portion in a securing direction of the hook when seen from the side in the direction perpendicular to the mounting direction of the unit, and wherein an angle formed by a barb-portion imaginary line extending from the rotation fulcrum portion to the barb portion and an imaginary line indicating an extending direction of the barb portion is set to be about 90 degrees or smaller.

* * * * *